US005509177A

United States Patent [19]

Hindin et al.

[11] Patent Number: 5,509,177

[45] **Date of Patent: *Apr. 23, 1996**

[54] WINDOW STAYS

[75] Inventors: Philip J. Hindin, Seatoun; Albert G. Bucher, Masterton, both of New Zealand

[73] Assignee: Interlock Industries Limited, Wellington, New Zealand

[ * ] Notice: The term of this patent shall not extend beyond the expiration date of Pat. No. 5,210,908.

[21] Appl. No.: 161,269

[22] Filed: Dec. 3, 1993

[30] Foreign Application Priority Data

Dec. 3, 1992 [NZ] New Zealand ..... 245359

[51] Int. Cl.[6] ..... E05D 3/06

[52] U.S. Cl. ..... 16/370

[58] Field of Search ..... 16/366, 368, 369, 16/370, 371; 49/246, 248

[56] References Cited

U.S. PATENT DOCUMENTS

| | | | |
|---|---|---|---|
| 4,226,002 | 10/1980 | Davis | 49/248 |
| 4,414,706 | 11/1983 | Douglas | 49/248 |
| 4,616,443 | 10/1986 | Azaki et al. | 49/248 |
| 5,210,908 | 5/1993 | Bucher | 16/368 |

FOREIGN PATENT DOCUMENTS

| | | | |
|---|---|---|---|
| 166853 | 2/1955 | Australia . | |
| 2258491 | 2/1993 | United Kingdom | 49/248 |
| 8800638 | 1/1988 | WIPO . | |

*Primary Examiner*—Maurina T. Rachuba
*Assistant Examiner*—Kenneth J. Hansen
*Attorney, Agent, or Firm*—Oblon, Spivak, McClelland, Maier & Neustadt

[57] ABSTRACT

A window stay of a geometry whereby, in the closed position of the stay, the pivot coupling the long arm to the sash plate is situated between the pivots respectively coupling the frame and sash plates to the short arm. The short arm is provided with a fold located between the pivot points thereof and extends substantially diagonally relative to an imaginary line between the pivot points. The pivot coupling the short arm to the frame plate is offset to the other pivots when the stay is closed by the frame plate forms an angle with respect to the length of the frame member to which the frame plate is, in use, attached.

14 Claims, 3 Drawing Sheets

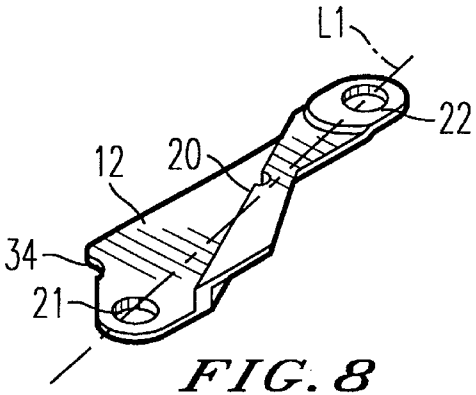
FIG. 8
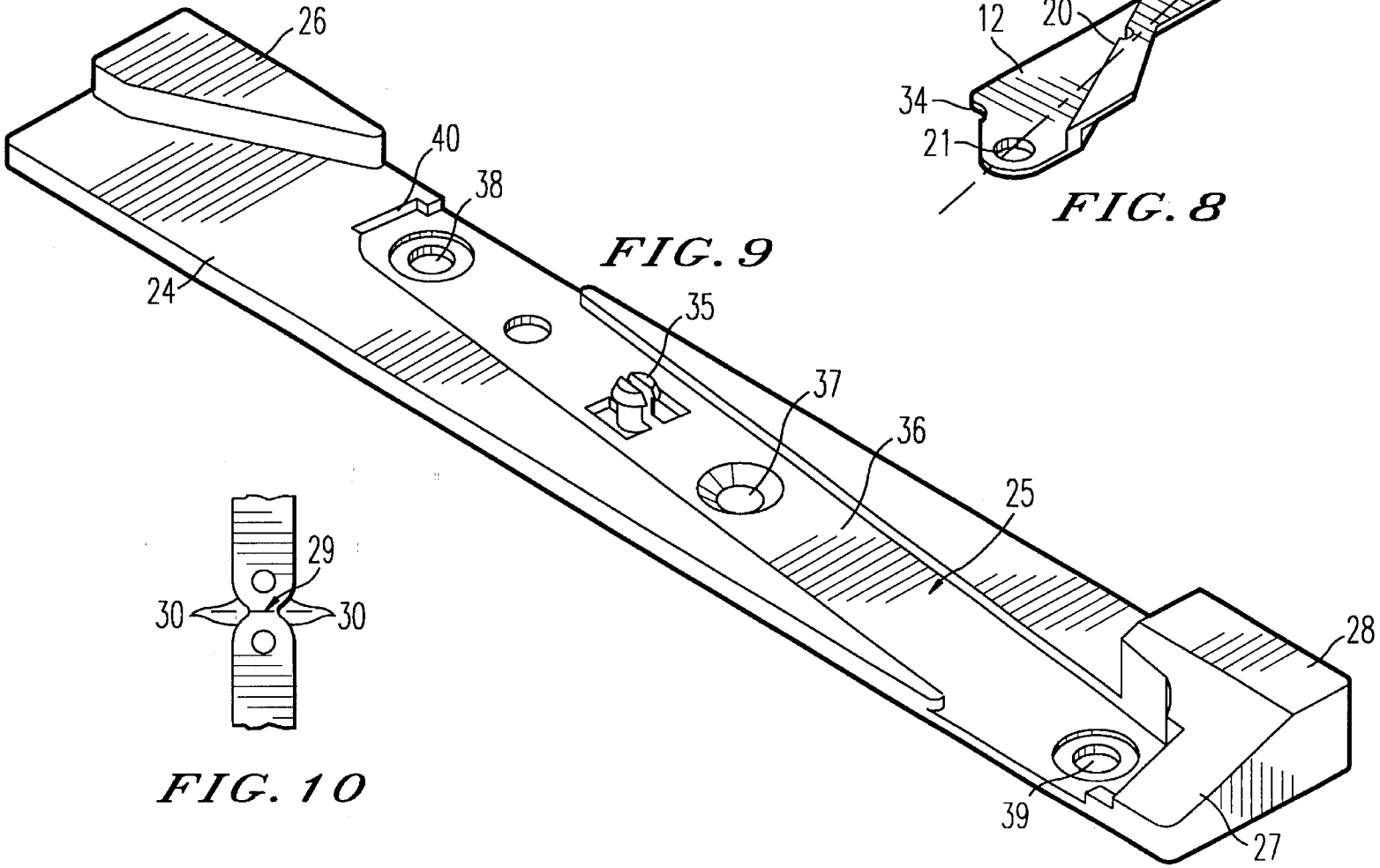
FIG. 9
FIG. 10

WINDOW STAYS

BACKGROUND OF THE INVENTION

1. Field of the Invention

This invention relates to a window stay.

2. Discussion of the Background

The so called 4 bar window stay consists of a frame mounting plate or plates and a sash mounting plate (or plates) which are coupled by a pair of arms. Typically one arm is significantly shorter than the other arm. A pair of such stays mounted between a sash and window frame provide an effective means of controlling the opening and closing of the sash. Generally the pivot joint or bearing which couples an arm to a mounting plate is a friction joint or bearing and thus the window sash can be held at any adjusted degree of openness.

Due to the absence of sliding components and the low number of components the 4 bar stay concept provides a robust, uncomplicated and long life solution to the adjustable mounting of a window sash in a window frame. However, successful use of a 4 bar stay for large heavy side hung sashes (i.e. a casement window) which open to 90° to provide good access to the outer surface of the glass for cleaning purposes is difficult. In particular if a small stay of low cost and/or compact size is used with such windows the sash tends to drop or sag. Also the operating life of the stay can prove to be inadequate.

To provide good accessibility to the outside surface of the glass for cleaning purposes, a comparatively long "short arm" is required. Such a short arm, however, has high bending moments induced in it when heavy sashes are supported. In a casement application it therefore tends to deflect downwardly allowing the sash to drop or sag. Also to provide 90° opening of the sash for good cleaning accessibility 4 bar stays must have the long arm to sash plate pivot situated between the frame plate to short arm pivot and the sash plate to short arm pivot. This results in a so called "overlap" but this is usually achieved at the expense, in structural terms, of the short arm.

A further problem commonly occurring with known constructions of 4 bar stays with significant "overlap" to obtain 90° opening in a stay of short overall length is that there are high internal loads in the bearings and components. Structural load analysis reveals that the bearing and arm loads can be reduced by off-setting the frame plate to the long arm bearing in a direction towards the sash outer surface (for an outwardly opening window). The effect of this is to put the loads generated in the long arm during final closing or initial opening of the sash at a more favorable angle to the sash plate and short arm. This reduces the long arm and bearing loads and hence the size of these components for a given stay life can also be reduced.

Previously known designs using an off-set frame plate to long arm bearing use either frame plates of sufficient width for the offset plus bearing width or a plate with an extension to carry the bearing (see, for example, Australian patent specification 166853). Such a design leads to unnecessary use of more expensive structural material where structural properties are not warranted.

SUMMARY OF THE INVENTION

An object of the present invention is thus to provide a window stay of the 4 bar type having an overlap configuration and being operable to substantially 90° yet with a short arm exhibiting good strength characteristics.

Broadly therefore the invention consists of a four bar window stay of a geometry whereby in the closed position of the stay the long arm to the sash plate pivot is situated between the frame plate to short arm pivot and the sash plate to short arm pivot characterized in that the short arm is provided with a fold located substantially in the length of the arm between the pivot points thereof and extends substantially diagonally relative to an imaginary line between said pivot points.

The concept of providing a fold in the short arm results in the short arm having a substantially "Z" cross-sectional shape when a section is taken transverse to the fold. Such an arrangement is simpler to produce than separately cranked arms with structural flanges as is commonly in current use. The design of short arm according to the invention allows good "overlap" but without sacrificing compact width and thickness of the stay. The invention results in good utilization of material to maximize the bending modulus (and moment of inertia) within compact dimensions. As a consequence the invention leads to a reduction in sash sag or drop.

According to a second broad aspect of the invention therefore the invention consists of a 4 bar window stay of a geometry whereby in the closed position of the stay the long arm to sash plate pivot is situated between the frame plate to short arm pivot and the sash plate to short arm pivot and the short arm to frame plate pivot is offset to a line between the long arm to frame plate pivot and short arm to sash plate pivot when the stay is in the closed position characterised in that to provide said offset the stay when in the closed position has the frame mounting plate located such that a line between the pivot joints thereof is located at an angle to a line representing the length of the frame member to which said frame plate is, in use, attached.

According to the invention therefore the geometry of the stay when in the closed position is such that the frame mounting plate can be of a simple generally straight sided length of material as is typically found with 4 bar window stays not having an offset bearing. As a result the frame mounting plate is located at an angle to the frame member to which it is mounted.

To facilitate correct location of the frame mounting plate a locating member which fits into the window stay cavity can be provided. This locating member can have a recess or other locating means into which or with which the frame mounting plate can be located such as to be at the correct angle relative to the length of the frame member.

This locating member can be of a lower cost material such as a plastics material. In a preferred form of the material the locating member can be molded in different thicknesses to provide for an inexpensive adaptation of the stay for differing cavity thicknesses.

Furthermore a "riser block" can also be molded into the locating member to sliding engage with the sash during opening but more especially closing of the stay so as to directly carry the weight of the sash at final closing of the stay.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 8 is a perspective view of the short arm, FIG. 9 is a perspective view of the locating, and FIG. 10 is a detail view of forming the end of a frame/sash mounting plate during manufacture.

DESCRIPTION OF THE PREFERRED EMBODIMENTS

Figure 1:
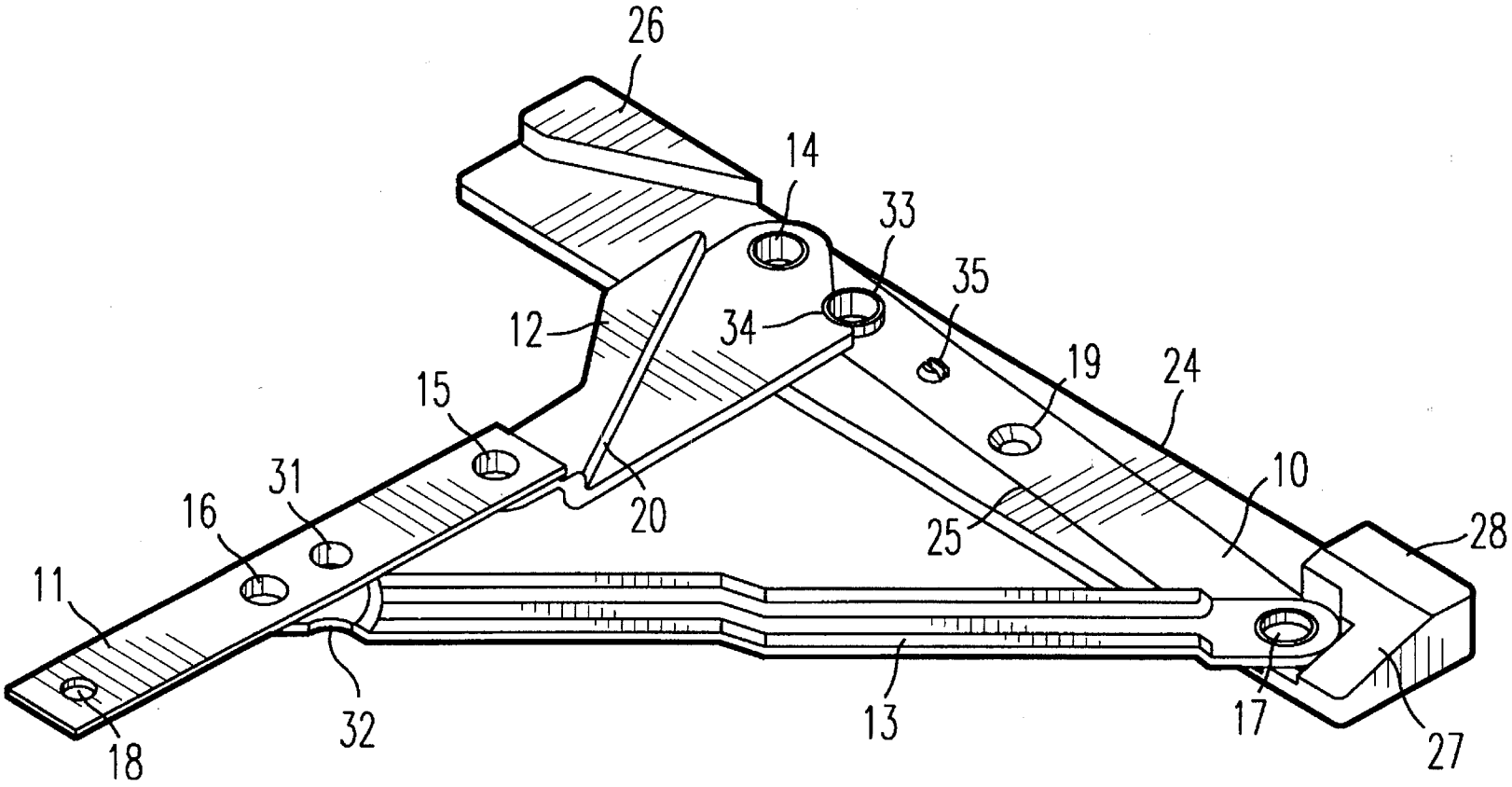
FIG. 1 is a perspective view of a window stay in the fully open position.

In the following description of the invention the stay will be described as having a single sash mounting plate and a single frame mounting plate. It will, however, be appreciated by those having knowledge of the window stay art that one or both of the sash and frame mounting plates can be formed in two separate pieces with each piece locating a respective pivot bearing joining the plates to the short and long arms. In the preferred form of the invention, however, a single mounting plate as described is used.

In broad terms the window stay being of a 4 bar design includes a frame mounting plate 10, a sash mounting plate 11, a short arm 12 and a long arm 13. These components (which are preferably of stainless steel construction) are coupled together by pivot bearings (preferably of a friction type) and preferably have a hollow center such that a fastener for fastening the stay to the sash and frame of the window can pass therethrough. However, the frame and sash plates 10 and 11 can be provided with openings 18 and 19 respectively through which fasteners can be passed to fasten the plates to the window frame and sash respectively. In the drawings the pivot bearings are as follows:

| Reference Number | Pivot Bearing |
|---|---|
| 14 | Short arm to frame mounting plate |
| 15 | Short arm to sash mounting plate |
| 16 | Long arm to sash mounting plate |
| 17 | Long arm to frame mounting plate. |

The frame and sash mounting plates 10 and 11 and long arm 13 are constructed in accordance with known techniques in the window stay art. This can include, for example, cranking of the long arm at a point in its length and providing the long arm with suitable strengthening ribs, recesses and the like.

Figure 3:
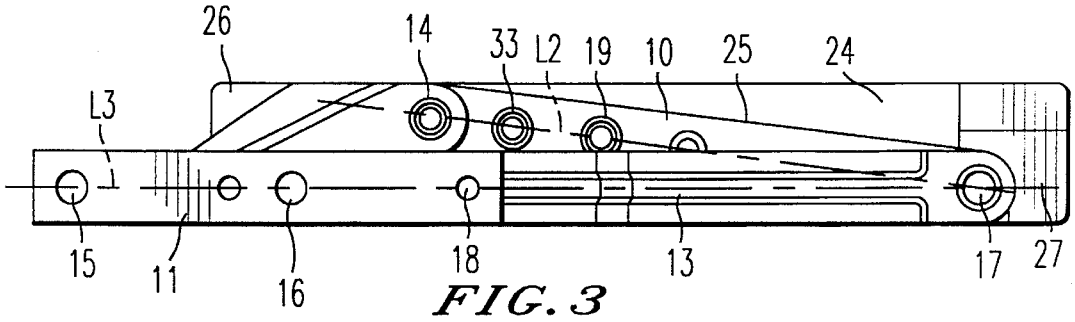
FIG. 3 is a plan view of the window stay shown in FIG. 2.
Figure 6:
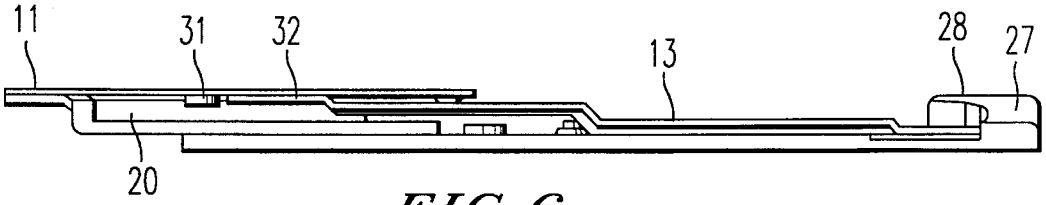
FIGS. 6 and 7 are end views in the directions of arrows "C" and "D" respectively.
Figure 7:
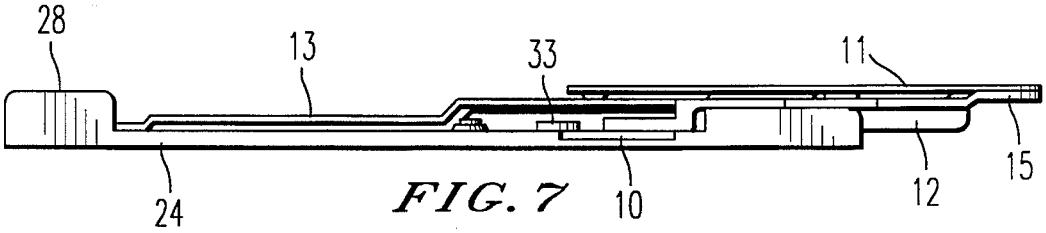
Figure 5:
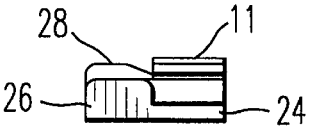
FIG. 5 is a similar view to FIG. 4 but in the direction of arrow "B"
Figure 4:
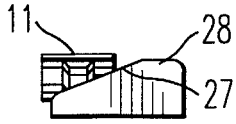
FIG. 4 is a side elevation view of the window stay in the direction of arrow "A"

According to the present invention the short arm 12 is folded in its diagonal length by a fold line or step 20 as can be more clearly seen in FIG. 3. This fold line 20 lies at an angle to a line L1 extending between the centers of the openings 21 and 22 through which pivot bearings 14 and 15 pass. Thus fold 20 can be described as passing diagonally across the width of the short arm 12.

As illustrated, frame plate 10 is in accordance with known techniques a single length of generally straight sided material. Thus when the stay is assembled and in the closed position (see FIG. 3) an imaginary line L2 (representing a central line of symmetry) passing between the centers of the pivot bearings 14 and 17 lies at an angle to a line L3 passing between pivot bearings 15 and 16. As a consequence pivot 17 is offset from pivot 14 toward line L3. The more pivot 17 can be moved toward line L3 the better the reduction in load on the pivots. Preferably therefore pivot 17 is substantially in line with pivots 15 and 16, i.e. lies substantially on line L3.

Therefore the geometry of the stay is such that it not only provides the required "overlap" for 90° opening of the sash (see FIG. 3) but also the required off-set of pivot 14 relative to pivots 15, 16 and 17 is provided so as to reduce bearing and arm loadings.

As illustrated in the drawings a locating member 24 can be provided, this locating member (more clearly shown in FIG. 9) being formed from a lower cost material such as plastics. Locating member 24 is provided with means of correctly locating the frame plate 10. This means can take different forms but preferably is a recess 25.

Recess 25 is of a depth substantially equal to the thickness of frame plate 10. Integrally formed in floor 36 of recess 25 is a heated bifurcated stud 35 which snap locks through an opening in frame plate 10 (see FIG. 1). Floor 36 also includes an opening 37 which aligns with fastener opening 19 in frame plate 10 and a pair of openings 38 and 39 which align with and accommodate the projecting part of pivots 14 and 17 respectively.

Figure 2:
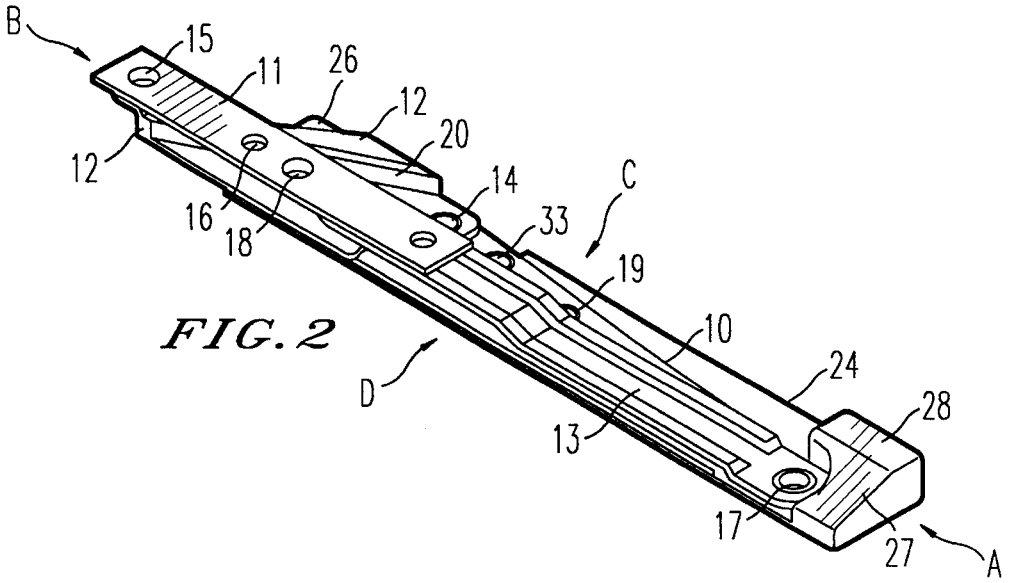
FIG. 2 is a perspective view of the window stay but showing it in a fully closed position.

As shown in FIGS. 2, 3, when the stay is in a closed position, the longitudinal edges of locating member 24 are at an angle with respect to a line L2 between pivots 14 and 17. Locating members of different thicknesses can be provided so as to allow for inexpensive adaptation of the stay for different cavity thicknesses.

In the preferred form of the locating member 24 as illustrated one end of the locating member can be provided with an area of increased thickness 26 which provides a stop against which the short arm engages (preferably at the step provided by fold 20) and partially overlaps when the stay is in the fully closed position.

At the other end of the locating member 24 a "riser" block 27 can be provided, this block 27 forming an inclined ramp. The ramp can engage with the sash as the sash closes such as to directly carry the weight of the sash and position it upon final closing of the stay. Generally the sash will be supported, when in the closed position, on the flat upper portion 28 of riser block 27.

The locating member 24 thus not only provides convenience for correct location of the frame plate 10 at an angle to the frame at installation but also provides other useful features connected with correct operation of the stay and positioning of the sash. However, this locating member can, in an alternative arrangement, be dispensed with and other means such as a template or the like can be used to correctly locate holes in the frame for mounting of the frame plate.

To maximize the bearing off-set for a given overall width of frame mount, a radius or chamfer is required on the frame plate. For example, the frame mounting width may be limited by a frame upstand for a weatherseal to seat thereon. Accordingly the present invention also proposes that the ends of the frame and/or sash mounting plates 10 and 11 have a profile consisting of a radius 29 with a flat 30. This flat 30 locates in a correspondingly shaped portion 40 in the wall of recess 25 in locating member 24.

This profile is manufactured in two stages with the first stage being shown in FIG. 10 in which one end of one plate is still connected to the other end of the next plate being produced in a progression staged press tool. The completion of the first stage provides the radius 29. In the final stage of the tool the plates are shear cut from each other this providing the flat 30 but does not involve the removal of a "slug".

Generally it has been the case that the frame and sash mounting plates have fully radiused ends. Thus, in conventional processing of these radiused ends, a slug is produced when cutting the component off the end of the strip. This is because a minimum thickness of punch must be provided for sufficient punch strength. This slug is an added cost during manufacture which the current proposal avoids.

In the preferred form of the stay, sash plate 11 has a projection 31 which in the fully open position of the stay engages with the edge of long arm 13 though preferably in a recess 32. Likewise an upstand or projection 33 of frame plate 10 engages in a recess 34 of short arm 12. These stops 31 and 33 interengaging with recesses 32 and 34 form limiters at the fully open position to prevent damage in the event the window is opened forcefully such as, for example, a high wind gust.

According to the present invention therefore the fold in the short arm provides a construction of a high moment of inertia which can withstand high forces applied to the short arm and, more particularly, when the stay is used to carry a large heavy side hung sash. Also the off-set bearing geometry can be achieved by using a conventionally configured frame mounting plate by locating the frame plate on an angle. This is a simple and a cost effective means of reducing high internal loadings in the bearings and stay components.

What is claimed is:

1. A window stay, which comprises:

a frame plate;

a sash plate;

an elongate short arm coupled respectively by a pivot at each end thereof to the frame plate and sash plate; and an elongate long arm coupled respectively by a pivot at each end thereof to the frame plate and sash plate, the geometry of the stay being such that, in a closed position of the stay, the pivot coupling the long arm to the sash plate is situated between the pivot coupling the frame plate to the short arm and the pivot coupling the sash plate to the short arm wherein the short arm is provided with a step located in the length of the short arm between the pivot coupling the short arm to the frame plate and the pivot coupling the short arm to the sash plate, said step extending across the width of the short arm and being disposed substantially diagonally relative to an imaginary line extending between said pivot coupling the short arm to the frame plate and the pivot coupling the short arm to the sash plate.

2. The window stay of claim 1 wherein the short arm is pivotally coupled to the frame and sash plates by friction bearings.

3. The window stay of claim 1 wherein the frame plate is engaged with an elongate locating member having longitudinal edges wherein a line between the pivots coupling the frame plate to the long and short arms is at an acute angle to the longitudinal edges of the elongate locating member.

4. The window stay of claim 3 wherein the elongate locating member is of plastics material and has a recess in which the frame plate is engaged.

5. The window stay of claims 3 or 4 which comprises a sash connected to the sash plate wherein the elongate locating member includes a riser block which in use of the stay is engageable, during final closing of the window stay, with the sash.

6. A window stay which comprises:

a frame plate;

an elongate short arm coupled by a pivot at each end to the respective frame plate and sash plate;

an elongate long arm coupled by a pivot at each end of the respective frame plate and sash plate, the geometry of the stay being such that, in a closed position of the stay, the pivot coupling the long arm to the sash plate is situated between the pivot coupling the frame plate to the short arm and the pivot coupling the sash plate to the short arm wherein the pivot coupling the short arm to the frame plate is offset from a line between the pivot coupling the long arm to the frame plate and the pivot coupling the short arm to the sash plate when the stay is in the closed position; and an elongate locating member having a longitudinal side edge wherein the frame plate is engaged upon said elongate locating member and aligned with the pivot coupling the long arm to the frame plate and the pivot coupling the short arm to the frame plate wherein a line between the pivot coupling the frame plate to the long arm and the pivot coupling the frame plate to the short arm is at an acute angle with respect to the longitudinal side edge of the locating member.

7. The window stay of claim 6 wherein the frame plate is elongate and wherein the pivots coupling the frame plate to the long arm and short arm are respectively located adjacent the ends of the frame plate, said frame plate having longitudinal edges and being engaged with the elongate locating member having said longitudinal side edge such that the longitudinal edges of the frame plate are at an angle to the longitudinal side edge of the elongate locating member.

8. The window stay of claim 1, wherein said step extends across substantially the entire width of the short arm.

9. The window frame of claim 7 wherein the locating member further includes an integrally formed stop which engages with said short arm.

10. The window stay of claim 6 wherein the elongate locating member is of plastics material and has a recess in which the frame plate is engaged.

11. The window stay of claim 6 which comprises a sash connected to the sash plate wherein the elongate locating member is of plastics material and has a recess in which the frame plate is engaged, said elongate locating member also including a riser block which in use of the stay is engageable during final closing of the window stay with the sash.

12. The window stay of claim 6 wherein the short arm is provided with a step located substantially along the length of the short arm between the pivot couplings of the short arm to the respective frame plate and sash plate, said step extending across the width of the short arm and substantially diagonally relative to an imaginary line between said pivot couplings of the short arm to the respective frame plate and sash plate, said locating member being formed of a plastics material and including an integrally formed stop which, when the stay is moved to the closed position, engages with said step in the short arm.

13. The window stay of claim 12 which comprises a sash connected to the sash plate wherein the locating member includes a riser block which in use of the stay is engageable, during final closing of the window stay, with the sash.

14. The window stay of claim 12 wherein the short arm is pivotally coupled to the respective frame and sash plates by friction bearings.

* * * * *